US008068063B2

(12) United States Patent
Hung et al.

(10) Patent No.: US 8,068,063 B2
(45) **Date of Patent: *Nov. 29, 2011**

(54) DUAL-BAND COUPLING DEVICE COMPRISING FIRST AND SECOND ANNULAR GROOVES FED BY FIRST AND SECOND FEED CONDUCTORS

(75) Inventors: Kuo-Fong Hung, Taipei (TW); Yi-Cheng Lin, Taipei (TW)

(73) Assignee: National Taiwan University, Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 12/840,200

(22) Filed: Jul. 20, 2010

(65) Prior Publication Data

US 2010/0277261 A1 Nov. 4, 2010

Related U.S. Application Data

(63) Continuation of application No. 12/259,974, filed on Oct. 28, 2008, now Pat. No. 7,864,125.

(30) Foreign Application Priority Data

Apr. 9, 2008 (TW) ..... 97112780 A

(51) Int. Cl.
*H01Q 13/22* (2006.01)
*H01P 1/161* (2006.01)

(52) U.S. Cl. ..... 343/769; 343/756; 333/21 A

(58) Field of Classification Search ..... 333/21 A; 343/756, 767, 769

See application file for complete search history.

(56) References Cited

U.S. PATENT DOCUMENTS

| | | | | |
|---|---|---|---|---|
| 3,755,759 | A | 8/1973 | Cohn | |
| 4,208,660 | A * | 6/1980 | McOwen, Jr. | 343/769 |
| 6,999,038 | B2 * | 2/2006 | Louzir et al. | 343/770 |
| 7,864,125 | B2 * | 1/2011 | Hung et al. | 343/769 |
| 2009/0046027 | A1 * | 2/2009 | Lin et al. | 343/756 |

* cited by examiner

*Primary Examiner* — Benny Lee

(57) ABSTRACT

A coupling device is provided. The coupling device has a substrate, a ground element, a first feed conductor and a second feed conductor. The substrate has a first surface and a second surface. The ground element is disposed on the second surface, wherein the ground element has a first annular groove, a second annular groove and a feed slot, the second annular groove surrounds the first annular groove, the feed slot is connected to the first annular groove and the second annular groove. The first feed conductor is disposed on the first surface corresponding to the first annular groove and the second annular groove, wherein the first feed conductor couples the ground element to feed an electric current. The second feed conductor is disposed on the first surface corresponding to the feed slot, wherein the second feed conductor couples the feed slot to feed a magnetic current.

8 Claims, 7 Drawing Sheets

DUAL-BAND COUPLING DEVICE COMPRISING FIRST AND SECOND ANNULAR GROOVES FED BY FIRST AND SECOND FEED CONDUCTORS

CROSS REFERENCE TO RELATED APPLICATIONS

This Application claims priority of Taiwan Patent Application No. 097112780, filed on Apr. 9, 2008, the entirety of which is incorporated by reference herein.

This application is a Continuation of U.S. patent application Ser. No. 12/259,974, filed Oct. 28, 2008, now U.S. Pat. No. 7,864,125, issued Jan. 4, 2011 and entitled "Dual-band coupling device comprising first and second annular grooves being fed by first and second feed conductors."

BACKGROUND OF THE INVENTION

1. Field of the Invention

The present invention relates to a coupling device, and in particular relates to a coupling device providing dual-band and dual-perpendicular-polarization functions.

2. Description of the Related Art

FIG. 1 shows a conventional coupling antenna 1, comprising a substrate 10, a ground element 20, a first feed conductor 30 and a second feed conductor 40. The substrate 10 comprises a first surface 11 and a second surface 12. The ground element 20 is disposed on the second surface 12, comprising a first portion 21, a second portion 22 and an annular groove 23. The annular groove 23 is located between the first portion 21 and the second portion 22. The first feed conductor 30 is disposed on the first surface 11 corresponding to the first portion 21 and the annular groove 23. The second feed conductor 40 is disposed on the first surface 11 corresponding to the first portion 21 and the annular groove 23.

When the conventional coupling antenna 1 transmits wireless signals, the signal isolation between the first feed conductor 30 and the second feed conductor 40 is insufficient, and noise is generated therebetween. Additionally, the conventional coupling antenna 1 can only transmit signals in a single band, which cannot satisfy multi-band signal transmission requirements.

SUMMARY OF THE INVENTION

A detailed description is given in the following embodiments with reference to the accompanying drawings.

A coupling device is provided. The coupling device has a substrate, a ground element, a first feed conductor and a second feed conductor. The substrate has a first surface and a second surface. The ground element is disposed on the second surface, wherein the ground element has a first annular groove, a second annular groove and a feed slot, the second annular groove surrounds the first annular groove, the feed slot has a first end and a second end, the first end is connected to the first annular groove, and the feed slot passes the second annular groove. The first feed conductor is disposed on the first surface corresponding to the first annular groove and the second annular groove, wherein the first feed conductor couples the ground element to feed an electric current. The second feed conductor is disposed on the first surface corresponding to the feed slot, wherein the second feed conductor couples the feed slot to feed a magnetic current.

The coupling device of the embodiment of the invention provides improved signal isolation and dual-band signal transmission.

DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
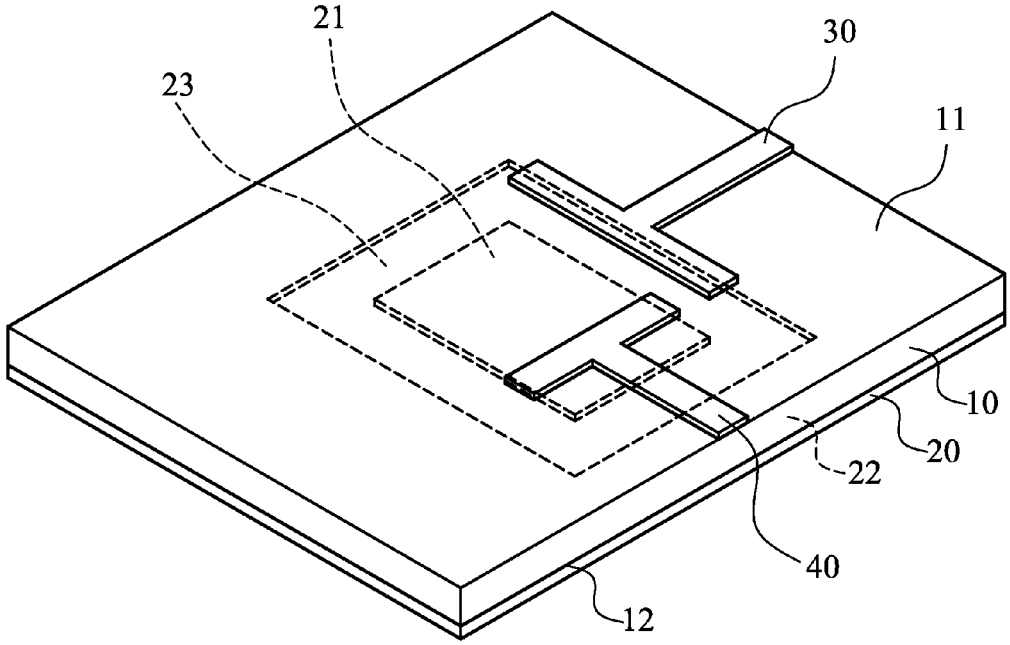
FIG. 1 (PRIOR ART)
FIG. 1 shows a conventional coupling antenna.
Figure 2:
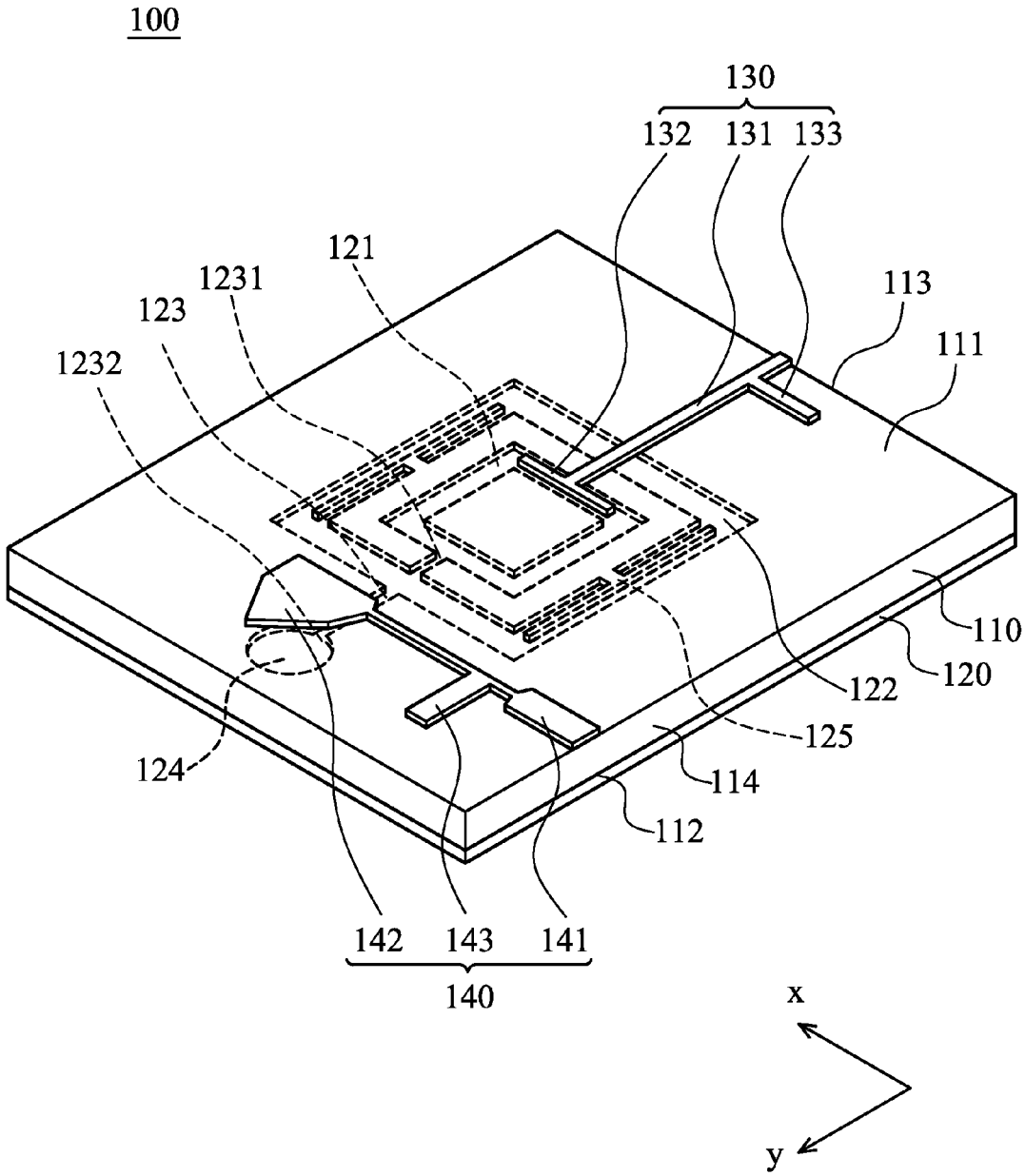
FIG. 2 shows a coupling device of an embodiment of the invention.
Figure 3:
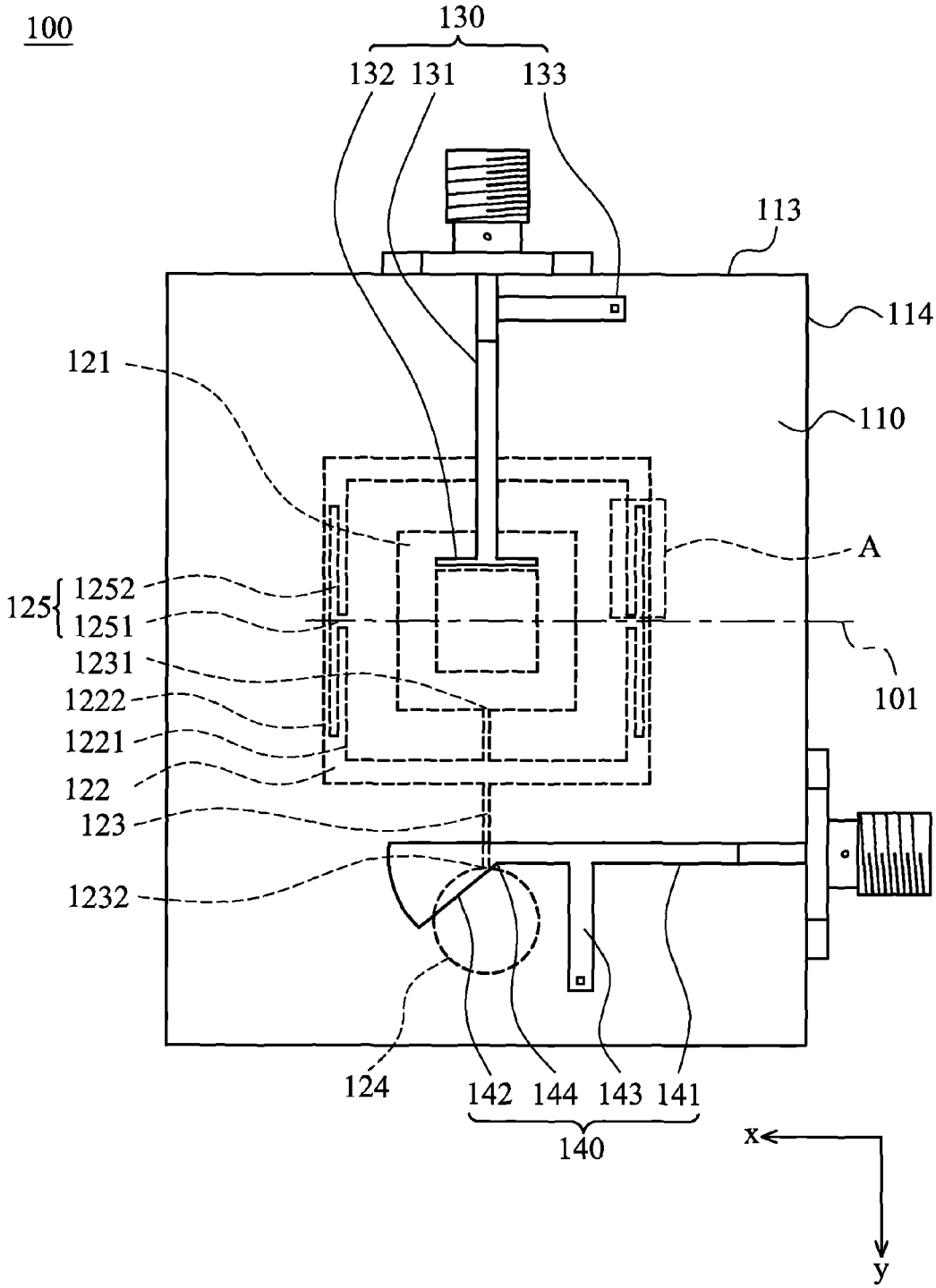
FIG. 3 is a top view of the coupling device of the embodiment of the invention.

FIGS. 2 and 3 show a coupling device 100 of an embodiment of the invention, comprising a substrate 110, a ground element 120 (FIG. 2), a first feed conductor 130 and a second feed conductor 140. The substrate 110 comprises a first surface 111 and a second surface 112 (FIG. 2). The ground element 120 is disposed on the second surface 112 as shown in FIG. 2. The ground element 120 comprises a first annular groove 121, a second annular groove 122, a feed slot 123 and a short circuit opening 124. The second annular groove 122 surrounds the first annular groove 121. The feed slot 123 comprises a first end 1231 and a second end 1232. The first end 1231 is connected to the first annular groove 121. The feed slot 123 is extended and passes the second annular groove 122. The second end 1232 is connected to the short circuit opening 124. The short circuit opening 124 is circular. The first feed conductor 130 is disposed on the first surface 111 corresponding to the first annular groove 121 and the second annular groove 122. The first feed conductor 130 couples the ground element 120 to feed an electric current. The second feed conductor 140 is disposed on the first surface 111 corresponding to the feed slot 123. The second feed conductor 140 couples the feed slot 123 to feed a magnetic current.

FIG. 3 is a top view of the coupling device 100 of the embodiment of the invention. With reference to FIGS. 2 and 3, the substrate 110 further comprises a first side 113 and a second side 114. The first side 113 is perpendicular to the second side 114. The first feed conductor 130 extends parallel to a first axis y from the first side 113. The second feed conductor 140 extends parallel to a second axis x from the second side 114. The first axis y is perpendicular to the second axis x.

The first feed conductor 130 comprises a first conductive portion 131, a first feed portion 132 and a first matching element 133. The first feed portion 132 corresponds to the first annular groove 121. The first conductive portion 131 extends parallel to the axis y from the first side 113 connected to the first feed portion 132. The first conductive portion 131 is perpendicular to the first feed portion 132. The first matching element 133 is connected and perpendicular to the first conductive portion 131.

The second feed conductor 140 comprises a second conductive portion 141, a second feed portion 142 and a second matching element 143. The second feed portion 142 corresponds to the feed slot 123. The second conductive portion 141 extends parallel to the second axis x from the second side 114 connected to the second feed portion 142. The second feed portion 142 is substantially fan-shaped, comprising a convergent end 144 (FIG. 3). The second conductive portion 141 is connected to the convergent end 144. The convergent end 144 corresponds to the second end 1232 of the feed slot 123. An open angle of the convergent end 144 is between 0° and 90°. The second matching element 143 is connected and perpendicular to the second conductive portion 141.

In one embodiment, the first matching element is omitted from the first feed conductor, and the second match element is omitted from the second feed conductor.

To clarify the description, a base line 101 is defined as shown in FIG. 3. The base line 101 extends parallel to the second axis x dividing the first and second annular grooves into equal parts. The second annular groove 122 comprises an inner edge 1221 and an outer edge 1222 as shown in FIG. 3. The inner edge 1221 nears the first annular groove 121. The ground element 120 (with reference to FIG. 2) further comprises an isolation portion 125. The isolation portion 125 extends from the inner side 1221 of the second annular groove 122 into the second annular groove 122 along the base line 101. The isolation portion 125 is T-shaped, comprising a stop section 1251 and a division section 1252 as shown in FIG. 3. The stop section 1251 extends along the base line 101, and the division section 1252 is surrounded by the second annular groove 122. An end of the stop section 1251 is connected to the division section 1252.

Figure 4A:
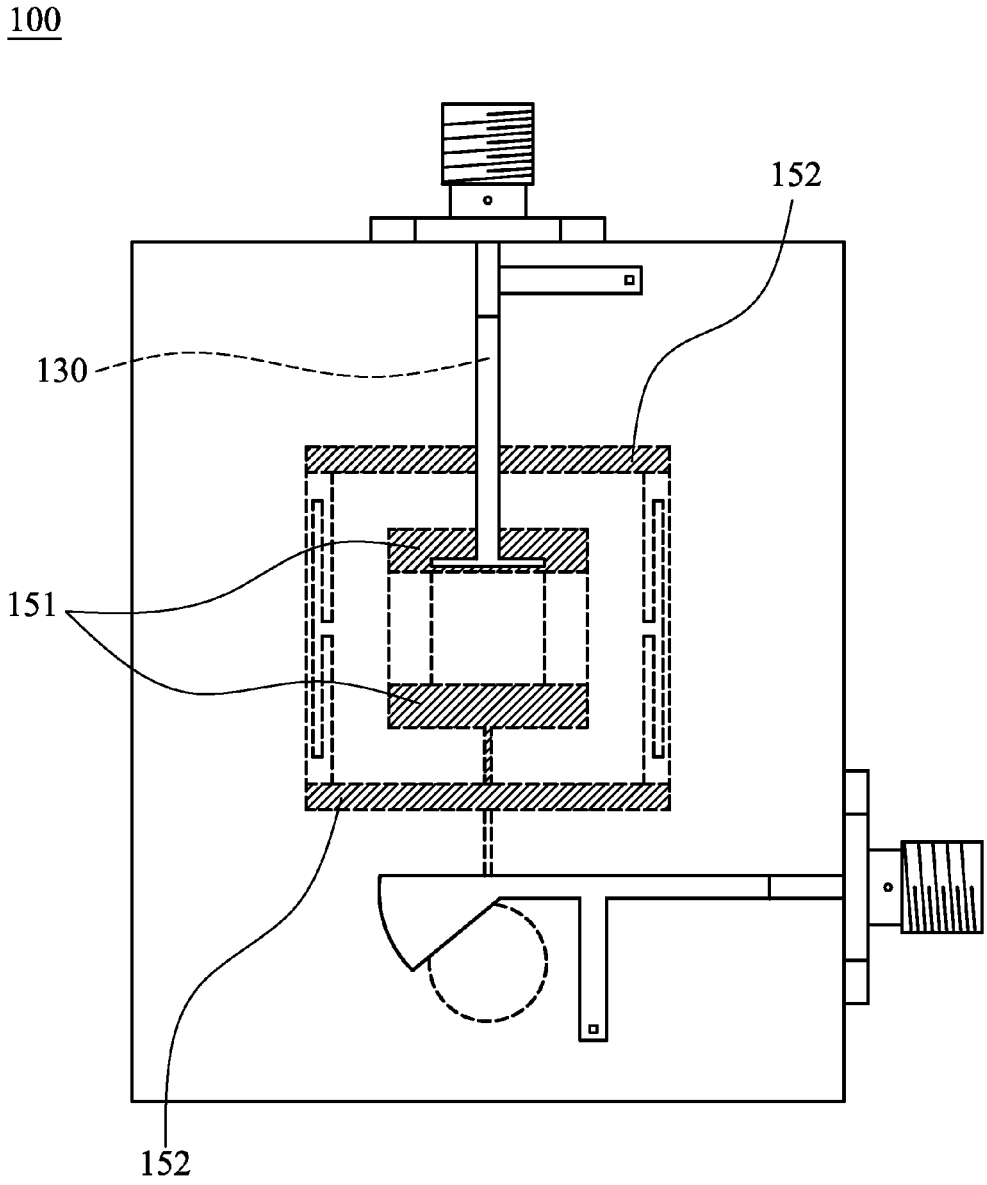
FIG. 4*a* shows a first radiation area and a second radiation area of the embodiment of the invention.
Figure 4B:
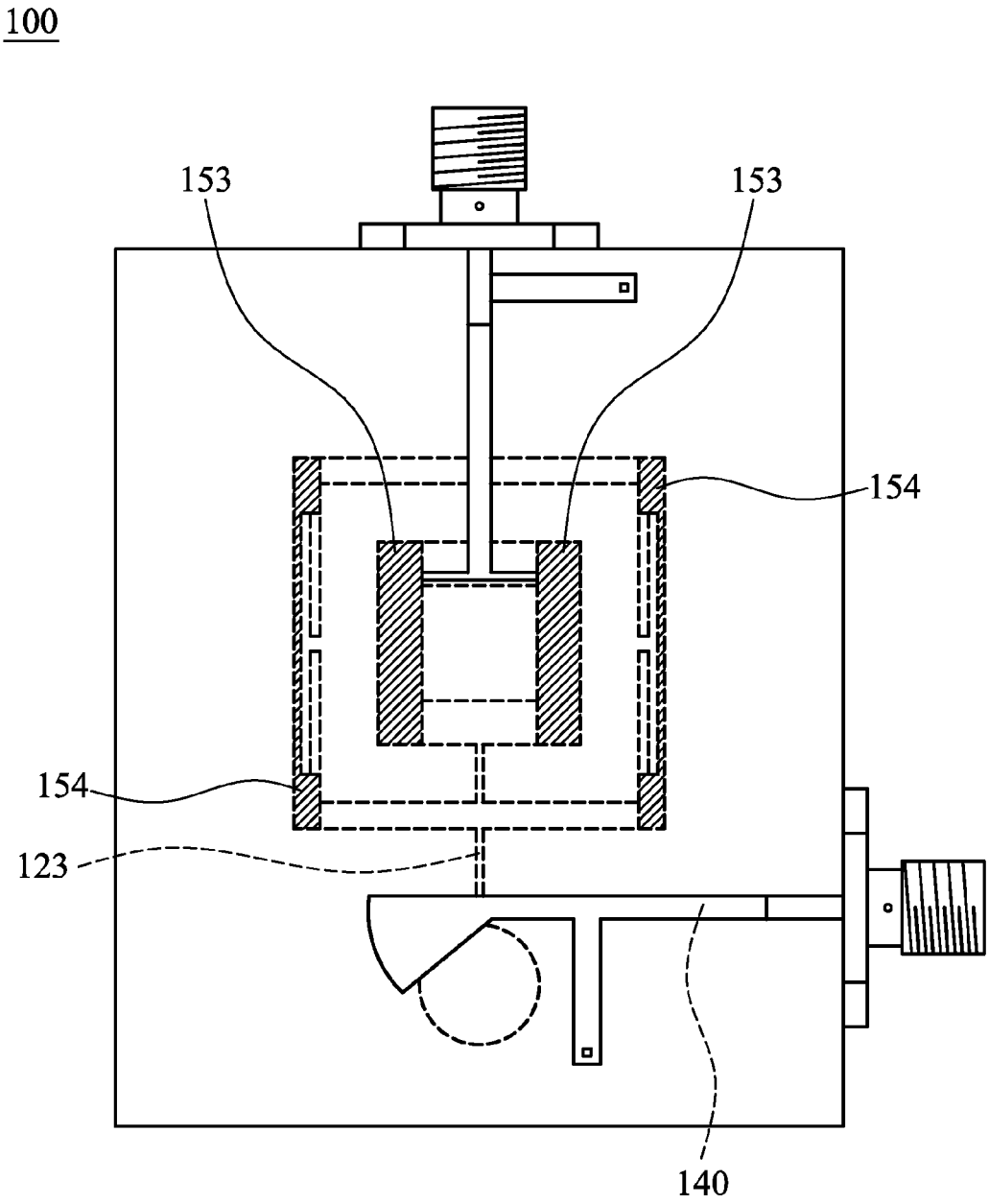
FIG. 4*b* shows a third radiation area and a fourth radiation area of the embodiment of the invention.

With reference to FIGS. 4*a* and 4*b*, when the coupling device 100 transmits a wireless signal, the first feed conductor 130 couples the ground element 120 (FIG. 2) to feed the electrical current, and the second feed conductor 140 couples the feed slot 123 to feed in the magnetic current. With reference to FIG. 4*a*, after the first feed conductor 130 couples the ground element 120 (FIG. 2) to feed the electrical current, a first wireless signal is transmitted via a first radiation area 151, and a second wireless signal is transmitted via a second radiation area 152. With reference to FIG. 4*b*, after the second feed conductor 140 couples the feed slot 123 to feed the magnetic current, a third wireless signal is transmitted via a third radiation area 153, and a fourth wireless signal is transmitted via a fourth radiation area 154. The resonance state of the first radiation area 151 and the second radiation area 152 is perpendicular to the resonance state of the third radiation area 153 and the fourth radiation area 154. The polarization direction of the first and second wireless signals is perpendicular to the polarization direction of the third and fourth wireless signals. In the embodiment of the invention, the first radiation area and the third radiation area provided by the first annular groove have shorter lengths, and are for transmitting high frequency signals. The second radiation area and the fourth radiation area provided by the second annular groove have longer lengths, and are for transmitting low frequency signals. Thus, the coupling device of the embodiment of the invention provides dual-band signal transmission.

Figure 5:
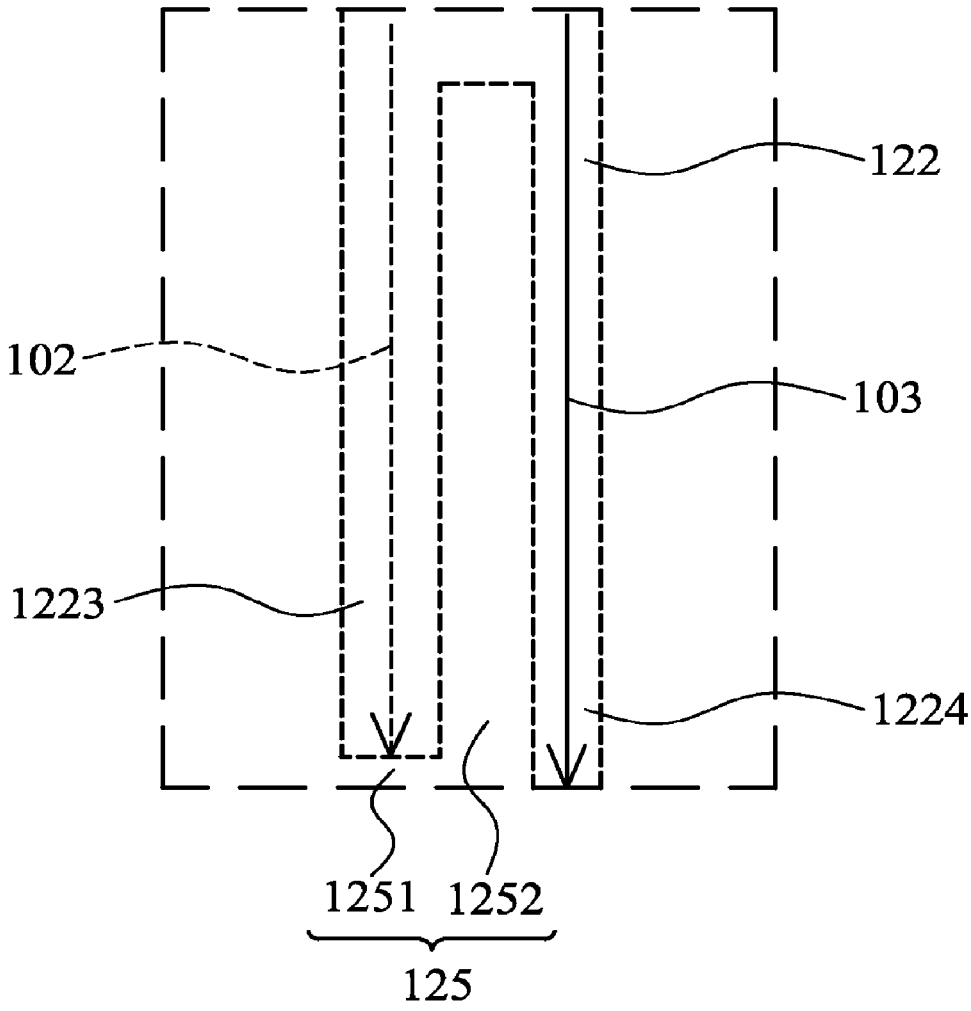
FIG. 5 is an enlarged view of portion A of FIG. 3.

FIG. 5 is an enlarged view of portion A of FIG. 3. As shows in FIG. 5, in the second annular groove 122, the division section 1252 of the isolation portion 125 separates the magnetic current 102 from the magnetic current 103. The magnetic current 102 travels in the divided slit 1223, and is finally stopped by the stop section 1251 of the isolation portion 125. The magnetic current 103 travels in the outer slot 1224, and resonates in the fourth radiation area to transmit the fourth wireless signal. With the isolation portion 125, signal isolation is improved, noise is reduced. Particularly, signal isolation between the first and second annular grooves is improved.

Figure 6:
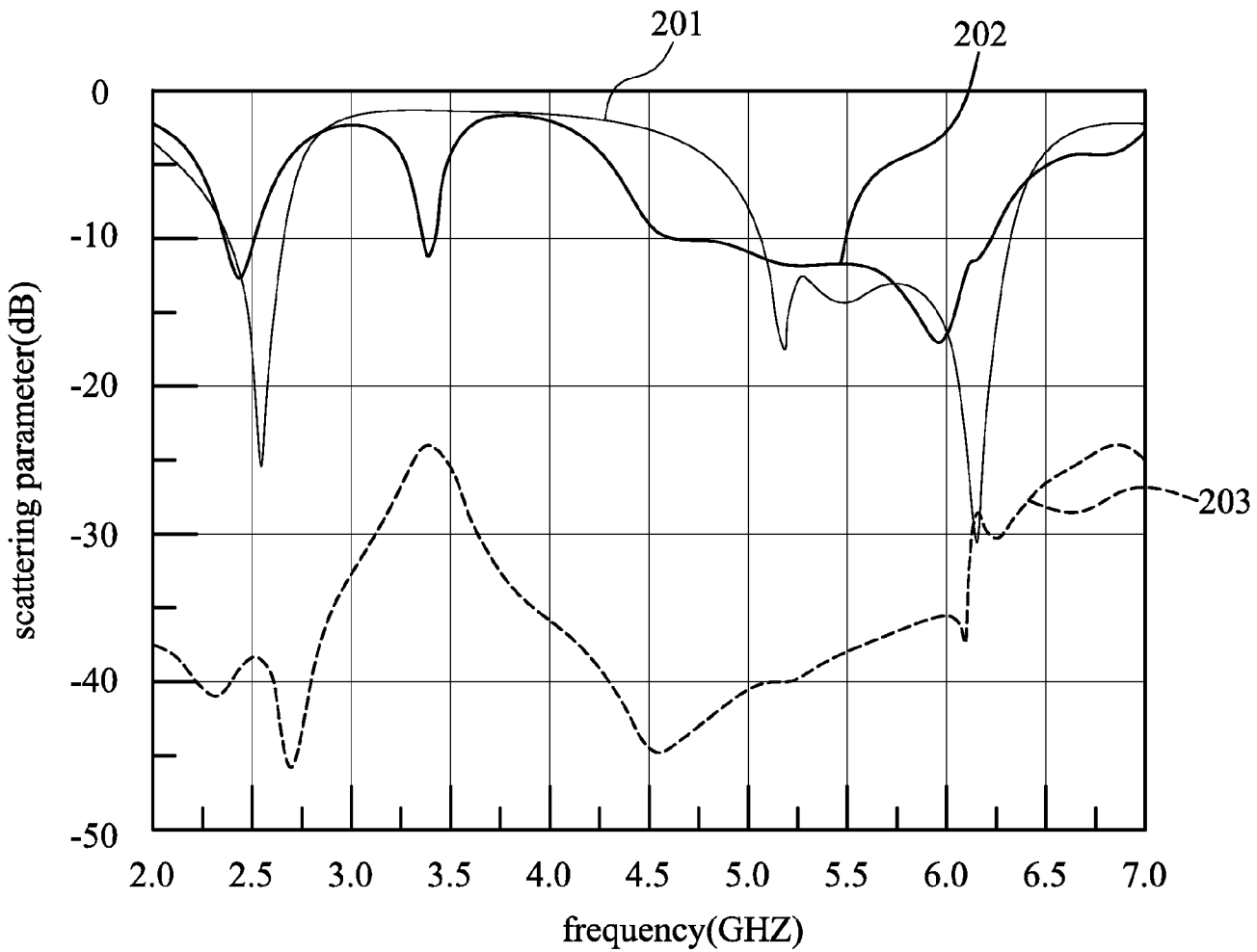
FIG. 6 shows the signal transmission response of the coupling device of the embodiment of the invention.

FIG. 6 shows the signal transmission response of the coupling device of the embodiment of the invention, wherein curve 201 represents the return loss (S11) of a first output port, curve 202 represents the return loss (S22) of a second output port, and curve 203 represents the isolation (S21) between the first and second output ports. As shown in FIG. 6, the S parameter of the curve 203 is substantially lower than −25 dB, wherein the unit of horizontal axis is frequency (GHz), and the unit of vertical axis is scattering parameters (dB). The coupling device of the embodiment of the invention provides improved port isolation. Additionally, with reference to the curve 201 and the curve 202, the coupling device 100 of the embodiment of the invention provides dual-band transmission.

The coupling device of the embodiment can be utilized as a feed structure of a dual-polarized antenna, or an orthomode transducer of a waveguide.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A coupling device, comprising:

a substrate, comprising a first surface and a second surface;

a ground element, disposed on the second surface, wherein the ground element has a first annular groove, a second annular groove and a feed slot, the second annular groove surrounds the first annular groove, the feed slot has a first end and a second end, the first end is connected to the first annular groove, and the feed slot passes the second annular groove;

a first feed conductor, disposed on the first surface corresponding to the first annular groove and the second annular groove, wherein the first feed conductor couples the ground element to feed an electric current; and a second feed conductor, disposed on the first surface corresponding to the feed slot, wherein the second feed conductor couples the feed slot to feed a magnetic current.

2. The coupling device as claimed in claim 1, wherein the substrate further comprises a first side and a second side, the first side is perpendicular to the second side, the first feed conductor extends along a first axis from the first side, the second feed conductor extends along a second axis from the second side, and the first axis is perpendicular to the second axis.

3. The coupling device as claimed in claim 2, wherein the first feed conductor comprises a first conductive portion and a first feed portion, the first feed portion corresponds to the first annular groove, and the first conductive portion extends from the first side along the first axis and is connected to the first feed portion.

4. The coupling device as claimed in claim 3, wherein the first feed conductor is T-shaped, and the first conductive portion is perpendicular to the first feed portion.

5. The coupling device as claimed in claim 2, wherein the second feed conductor comprises a second conductive portion and a second feed portion, the second feed portion corresponds to the feed slot, and the second conductive portion extends from the second side along the second axis and is connected to the second feed portion.

6. The coupling device as claimed in claim 1, wherein the first feed conductor transmits a first wireless signal and a second wireless signal, the second feed conductor transmits a third wireless signal and a fourth wireless signal, and a polarization direction of the first and second wireless signals is perpendicular to a polarization direction of the third and fourth wireless signals.

7. The coupling device as claimed in claim 1, wherein the coupling device is a feed structure of a dual-polarized antenna.

8. The coupling device as claimed in claim 1, wherein the coupling device is an orthomode transducer of a wave guide.

* * * * *